US006918433B2

(12) United States Patent
Kontu

(10) Patent No.: US 6,918,433 B2
(45) Date of Patent: Jul. 19, 2005

(54) HEAT EXCHANGER WITH PLATE STRUCTURE

(75) Inventor: Mauri Kontu, Kalanti (FI)

(73) Assignee: Vahterus Oy, Kalanti (FI)

( * ) Notice: Subject to any disclaimer, the term of this patent is extended or adjusted under 35 U.S.C. 154(b) by 346 days.

(21) Appl. No.: 10/362,025

(22) PCT Filed: Aug. 23, 2001

(86) PCT No.: PCT/FI01/00741

§ 371 (c)(1),
(2), (4) Date: Feb. 19, 2003

(87) PCT Pub. No.: WO02/16852

PCT Pub. Date: Feb. 28, 2002

(65) Prior Publication Data

US 2004/0031600 A1 Feb. 19, 2004

(30) Foreign Application Priority Data

Aug. 23, 2000 (FI) ..... 20001860

(51) Int. Cl.[7] ..... F28F 9/22; F28F 3/00

(52) U.S. Cl. ..... 165/160; 165/135; 165/145; 165/161; 165/167

(58) Field of Search ..... 165/135, 145, 165/160, 161, 166, 167

(56) References Cited

U.S. PATENT DOCUMENTS 1,348,455 A * 8/1920 Spicer et al. ..... 165/160
2,183,160 A * 12/1939 Coulter et al. ..... 165/161
3,630,276 A * 12/1971 Paine et al. ..... 165/161
3,768,554 A * 10/1973 Stahl ..... 165/160
4,260,013 A * 4/1981 Sumitomo ..... 165/167
4,548,260 A * 10/1985 Stachura ..... 165/160
5,088,552 A 2/1992 Raunio
5,509,471 A 4/1996 Hallgren
5,823,253 A * 10/1998 Kontu ..... 165/167
6,085,832 A 7/2000 Rehberg

FOREIGN PATENT DOCUMENTS

| | | |
|---|---|---|
| DE | 2 161 604 | 6/1973 |
| DE | 2 232 586 | 1/1974 |
| FR | 1 300 866 | 7/1962 |
| WO | WO 97/45689 | 12/1997 |

* cited by examiner

*Primary Examiner*—Leonard R. Leo
(74) *Attorney, Agent, or Firm*—Nixon & Vanderhye P.C.

(57) ABSTRACT

The invention relates to a heat exchanger (1) with plate structure, comprising a stack (6) of plates composed of circular heat transfer plates (10) by welding and fitted inside a housing unit (2) used as a pressure vessel, whose periphery is provided with flow guides (21, 22), by means of which the second heat transfer medium is guided to desired ducts in the stack (6) of plates. By means of spacing plates (32) fixed inside the flow guides (21, 22), it is possible to arranged several draughts for the stream of the heat transfer medium.

8 Claims, 1 Drawing Sheet

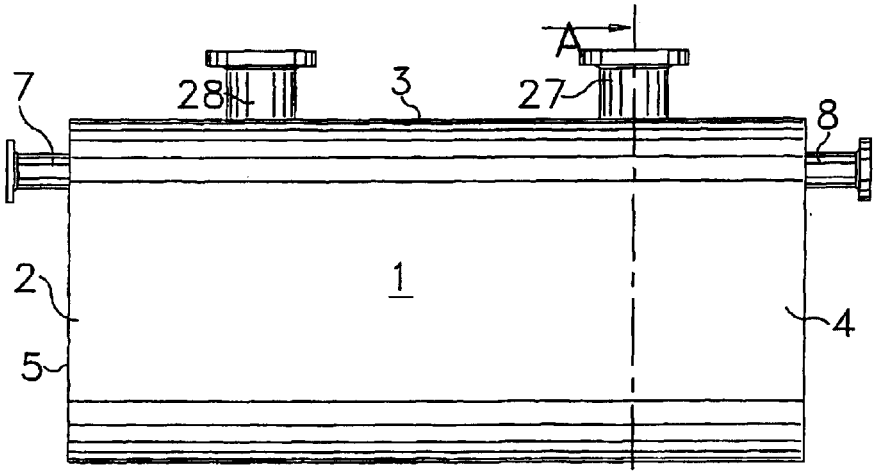
FIG 1
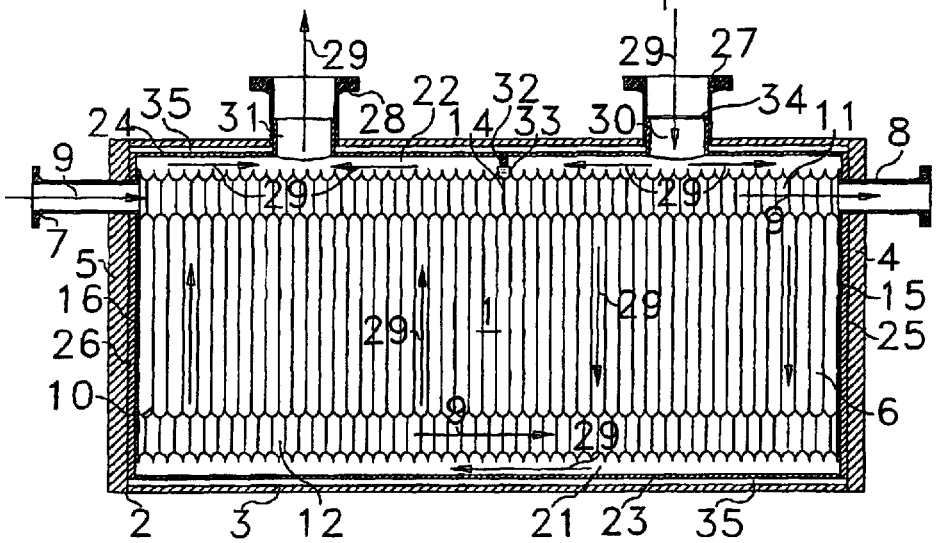
FIG 2
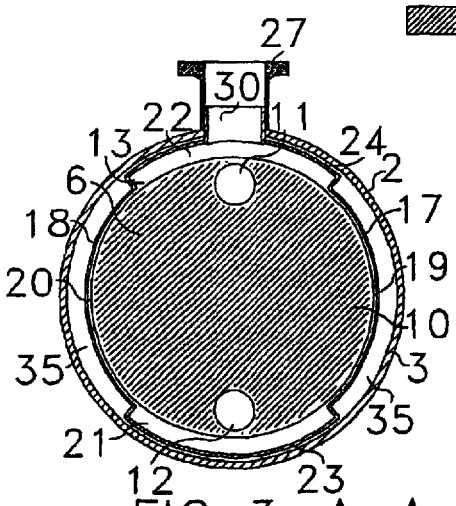
FIG 3 A–A
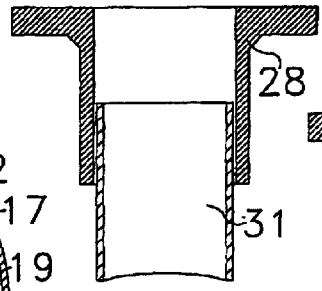
FIG 4
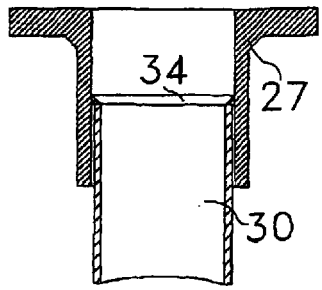
FIG 5

HEAT EXCHANGER WITH PLATE STRUCTURE

This application is the U.S. national phase of international application PCT/FI01/00741 filed 23 Aug. 2001 which designated the U.S.

The invention relates to a welded heat exchanger with a plate structure for heat transfer between substances in the same state or in different states, such as a gas or a liquid. The heat transfer surfaces consist of heat transfer plates attached to each other and collected in a stack of plates which are circular in shape and which have at least two flow openings for the supply and discharge of a heat transfer medium through ducts formed by the plates. The plates of the heat exchanger are welded together in pairs at the peripheries of the flow openings, and the plate pairs are connected to each other by welding the plates of the plate pairs at their peripheries to the plates of other plate pairs. The stack of plates is fitted inside a cylindrical housing unit used as a pressure vessel. The invention relates to an arrangement, by means of which it is possible to lead the stream of the second heat transfer medium through the housing unit into and from desired ducts in the stack of plates in a desired direction.

A conventional plate heat exchanger is composed of superimposed plates which form a stack of plates which is clamped between two end plates by means of tie bars. The ducts formed by the plates and the flow openings connected thereto are sealed at their peripheries by means of separate sealings. The plates of such plate heat exchangers are typically rectangular in shape, and the flow openings, usually four in number, are placed in the vicinity of the corners. In conventional plate heat exchangers, the streams of the heat transfer medium are normally arranged in such a way that the flow openings at opposite corners are used as inlet and outlet ducts, wherein the streams of the primary and secondary sides flow in adjacent ducts formed by the heat transfer plates. In conventional plate heat exchangers, it has been possible to step the streams of the primary and secondary sides and to divide them into several draughts by closing the flow openings at desired locations.

Conventional tubular heat exchangers, in which the second heat transfer medium streams in a bundle of tubes fitted inside a cylinder, normally apply plate-like flow guides which are perpendicular to the bundle of tubes. Thus, the stream of the heat transfer medium inside the cylinder, which normally flows to the secondary side, will pass several times through the bundle of tubes. The number of flow guides can be used to accelerate the stream inside the cylinder and to induce turbulence in the stream, wherein the heat transfer properties can be improved. However, the dimensioning of tubular heat exchangers is normally based on the heat transfer inside the tubes, which is normally smaller than the heat transfer outside the bundle of tubes. The large size of tubular heat exchangers is largely due to poor heat transfer inside the tube. The diameter of the cylinder of the tubular heat exchanger is normally small in relation to the length of the cylinder. The stream inside the cylinder is, in most cases, arranged to flow from one end to another. Because of the shape of the heat exchanger, there are normally no sealing requirements set for the flow guides used as the support means for the bundle of tubes.

In heat exchangers composed of circular heat transfer plates, in which the stack of plates is placed inside a cylinder, it has been problematic to arrange the stream of the secondary side inside the cylinder in such a way that there is no by-pass flow. In heat exchanger structures of this kind, the stream passing through the flow guides passes almost all the heat transfer surfaces, thereby substantially reducing the heat transfer properties. For this reason, flexible flow guides made of a metal sheet have been used in heat exchangers, to press rubber sealings or the like towards the outer surface of the stack of plates and towards the inner surface of the housing of the heat exchanger. The function of these flow guides is to prevent the transverse by-pass flow between the stack of plates and the housing. Thanks to their flexible structure, these flow guides have served well in operation. On the contrary, the stiff spacing plates which have been used to divide the stream on the secondary side into several draughts have often proved to be leaky, even though they have been provided with rubber sealings against the stack of plates and the housing.

The aim of the present invention is to provide a welded heat exchanger made of circular heat transfer plates, which has the good pressure resistance properties of the tubular heat exchanger and whose heat transfer properties correspond to those of a conventional plate heat exchanger and whose modification possibilities to provide several draughts on the primary and secondary sides correspond to the properties of a conventional plate heat exchanger.

The invention is based on the idea that flow guides with an internal tube structure are provided outside the stack of plates, inside the housing of the heat exchanger, which flow guides are fixed at least partly to the stack of plates but, through a small hole or opening therein a connection is formed to the closed space between the housing and the stack of plates, whereby the stream through the space is prevented and the flow guides can be dimensioned as parts not belonging to the pressure vessel.

More precisely, the heat exchanger with plate structure according to the invention is characterized in what will be presented in the characterizing part of claim 1.

In the heat exchanger with plate structure according to the invention, flow guides for guiding the secondary heat transfer medium with an internal tube structure, fixed to the stack of plates, are provided on the periphery of the stack of plates; there are at least two flow guides, and they are placed on opposite sides of the stack of plates to guide the stream into and from desired ducts of the stack of plates. To divide the secondary stream into several draughts, spacing plates are mounted inside the housing of the flow guides, the plate stack side of the spacing plates being sealed with a rubber sealing or the like. The flow guides are connected to the inlet and outlet passages of the housing of the heat exchanger with plate structure by means of tubes which are located partly inside them and of which at least one is welded to the inner surface of the passage. In the heat exchanger according to the invention, the heat transfer medium has free access, through a hole in the flow guide or through a tube not connected to the passage, to the space between the stack of plates and the housing, in which the heat transfer medium cannot, however, flow anywhere, the space being closed in other parts.

Significant advantages are achieved by the heat exchanger with plate structure according to the invention. The streams on the primary and secondary sides can be divided in a desired manner, whereby the number of draughts can be freely selected, depending on the properties of the heat transfer media and the stream quantities. The heat exchanger with plate structure can be used as a concurrent, countercurrent or cross flow heat exchanger. In the heat exchanger with plate structure according to the invention, the heat transfer properties of the heat exchanger are not reduced by by-pass flows. The flow guides are plate parts with a light-weight structure, because they are not parts of the pressure vessel.

In the following, the heat exchanger with plate structure according to the invention will be described in more detail with reference to the appended drawings, in which FIG. 1 shows schematically the heat exchanger with plate structure according to the invention in a side view, FIG. 2 shows schematically the heat exchanger with plate structure as shown in FIG. 1 in a cross-section, FIG. 3 shows schematically the cross-section of the heat exchanger with plate structure as shown in FIG. 1, at the location of line A—A, FIG. 4 shows schematically the outlet passage of the housing of the heat exchanger with plate structure according to the invention, in a cross-section, and FIG. 5 shows schematically the inlet passage of the housing of the heat exchanger with plate structure according to the invention, in a cross-section.

In the following, the invention will be described in more detail with reference to the appended drawings. FIGS. 1 to 5 show an embodiment of the heat exchanger with plate structure 1 according to the invention, with two draughts both on the primary side and on the secondary side. The housing unit 2 used as a pressure vessel for the heat exchanger with plate structure comprises a housing 3 and end plates 4 and 5 which are fixed to the housing 3 in a stationary manner. The housing unit 2 accommodates a stack 6 of plates forming the heat transfer surfaces, which stack can be removed for cleaning and maintenance, for example, by connecting one of the ends 4, 5 with a flange joint to the housing 3. A heat transfer medium flowing inside the stack 6 of plates forms a primary stream which is led to the stack 6 of plates through the end plate 5 via an inlet passage 7 and is discharged via an outlet passage 8 in the opposite end 4. The passage of the primary stream is illustrated with arrows 9.

The stack 6 of plates forms the heat exchange surfaces of the heat exchanger 1, which are composed of circular grooved heat transfer plates 10 connected to each other. The heat transfer plates 10 are connected together in pairs by welding at the peripheries of flow openings 11 and 12, and the pairs of plates are connected to each other by welding at the peripheries 13 of the heat transfer plates 10. The flow openings 11 and 12 constitute the inlet and outlet passages of the primary stream inside the stack 6 of plates, through which passages the heat transfer medium is led and discharged from the ducts formed by the heat transfer plates. By closing the flow openings 11, 12, the stream on the primary side can be divided into several draughts. FIG. 2 shows that closing the flow passage 11 at point 14 changes the stream of the primary side into two draughts.

The stack 6 of plates is assembled and pre-tightened by welding the end plates 15, 16 in the stack 6 of plates together with side support plates 17, 18. To avoid a by-pass flow of the heat transfer medium in the space between the stack 6 of plates and the side support plates 17, 18, the space is provided with rubber sealings 19, 20 or the like before the assembly. The housings 23, 24 of the flow guides 21, 22 are connected at their sides by welding to the side support plates 17, 18. The ends of the flow guides 21, 22 are closed with separate end plates 25, 26, or by welding the housings 23, 24 of the flow guides 21, 22 directly to the end plates 15, 16 of the stack 6 of plates.

The heat transfer medium of the stream on the secondary side is led into the housing unit 2 through an inlet passage 27 penetrating the housing 3 and is discharged via an outlet passage 28. The stream on the secondary side is illustrated with arrows 29 in FIG. 2. The flow guide 22 is connected to the inlet passage 27 and the outlet passage 28 by means of tubes 30 and 31 which are partly fitted in the inlet and outlet passages. The flow guide 22 is divided into two parts by means of a spacing plate 32 welded in the housing 24 of the flow guide 22. A rubber sealing 33 or a corresponding arrangement is used between the spacing plate 32 and the stack 6 of plates to prevent a by-pass flow in the flow guide 22. The number of draughts on the secondary side can be increased by adding spacing plates 32 in the flow guides 21, 22. FIGS. 4 and 5 show how the tubes 30, 31 related to the flow guide 22 are partly fitted inside the inlet and outlet passages 27 and 28. In the embodiment of the invention shown in FIGS. 1 to 5, the tube 30 fitted inside the inlet passage 27 is tightly welded with a seam 34 to the inner surface of the inlet passage 27. Between the outlet passage 28 and the tube 31 fitted therein, however, a gap is left, through which the heat transfer medium is allowed to flow into the space 35 between the housing 3, the flow guides 21, 22 and the support plates 17, 18 for the stack 6 of plates.

The heat exchanger 1 with plate structure according to the invention is normally used by controlling the streams on the primary and secondary sides. The only limitation to the use of the device is the first starting up, wherein it must be taken into account that the flow guides 21, 22 are not parts of the pressure vessel and that a certain delay time must be reserved for the space 35 to be filled up with the heat transfer medium. It is obvious for anyone skilled in the art that only one embodiment of the inventive idea has been presented above, which may naturally vary within the scope of the claims. For example, the number of draughts on the primary and secondary sides of the heat exchanger 1 may be different, and the locations of the inlet and outlet passages 7, 8, 27, 28 can be almost freely selected. The connection of the flow guides 21, 22 to the inlet and outlet passages 27, 28 of the secondary side can be arranged in such a way that the stack 6 of plates can be easily detached from the housing unit 2. Also, the filling up of the space 35 inside the housing 3 with the heat transfer medium can be implemented in a way different from that presented above.

What is claimed is:

1. Heat exchanger (1) with plate structure, preferably welded, intended for the heat transfer between substances in the same or in different states, such as a gas and a liquid, comprising a closed stack (6) of plates consisting of circular heat transfer plates (10) used as heat transfer surfaces and connected to each other at their peripheries (13) or at the peripheries of their flow openings (11, 12), one heat transfer medium flowing inside said stack (6), a housing unit (2) used as a pressure vessel and consisting of ends (4, 5) supporting the stack (6) of plates and the surrounding housing (3), another heat transfer medium flowing inside said housing unit (2), and inlet and outlet passages (7, 8, 27, 28) for the heat transfer media flowing in the stack (6) of plates and in the housing unit (2), extending through the housing (3) and the ends (4, 5), characterized in that on the periphery (13) of the stack (6) of plates, inside the housing (3), there are flow guides (21, 22) for the heat transfer medium flowing inside the housing unit (2), having an internal tube structure and being at least partly connected to the stack (6) of plates, that there are at least two flow guides (21, 22) with an internal tube structure, being preferably arranged on opposite sides of the stack (6) of plates, and that the flow guides (21, 22) are connected to the inlet and outlet passages (27, 28) of the housing unit (2) by means of tubes (30, 31) arranged at least partly in the passages, of which at least one is connected in a leakproof manner, preferably by welding, to the inner surface of the inlet and/or outlet passage (27, 28) of the housing unit (2).

2. Heat exchanger (1) with plate structure according to claim 1, characterized in that the flow guides (21, 22) are connected at their sides to the side support plates (17, 18) of the stack (6) of plates and at their ends to separate end plates (25, 26) or to the end plates (15, 16) of the stack (6) of plates.

3. Heat exchanger (1) with plate structure according to claim 1, characterized in that the flow guides (21, 22) are elements with plate structure which do not belong to the pressure vessel.

4. Heat exchanger (1) with plate structure according to claim 1, characterized in that rubber or corresponding sealings (19,20) are fitted underneath side support plates (17, 18) for the stack (6) of plates to prevent a stream between the slack (6) of plates arid the side support plates (17, 18).

5. Heat exchanger (1) with plate structure according to claim 1, characterized in that spacing plates (32) of the flow guides (21, 22) are preferably connected by welding to the housings (23, 24) of the flow guides (21, 22), and that 97 edge of the spacing plates (32) on the side of the stack of plates is sealed with a rubber sealing (33) or the like.

6. The heat exchanger (1) with plate structure according to claim 1, characterized in that the space (35) between the stack (6) of plates, the flow guides (21, 22) and the housing (3) of the housing unit (2) is filled with a non-flowing heat transfer medium.

7. Heat exchanger (1) with plate structure according to claim 1, characterized in that the flow guides (21, 22) comprise at least one opening to lead heat transfer medium to the space between the housing unit (2), the stack (6) of plates and the flow guides (21, 22).

8. Heat exchanger (1) with plate structure according to claim 7, characterized in that said opening is arranged in such a way that the tube (30, 31) fitted inside the inlet or outlet passage (27; 28) is connected to said passage (27; 28) in a leaking manner.

* * * * *